United States Patent [19]

Haneda

[11] Patent Number: 4,786,939

[45] Date of Patent: Nov. 22, 1988

[54] IMAGE FORMING APPARATUS

[75] Inventor: Satoshi Haneda, Hachioji, Japan

[73] Assignee: Konishiroku Photo Industry Co., Ltd., Tokyo, Japan

[21] Appl. No.: 897,651

[22] Filed: Aug. 18, 1986

[30] Foreign Application Priority Data

Aug. 23, 1985 [JP] Japan ..... 60-186433
Aug. 23, 1985 [JP] Japan ..... 60-186434

[51] Int. Cl.[4] ..... G03G 15/01

[52] U.S. Cl. ..... 355/4; 355/3 R; 355/30 R; 355/14 R; 430/42; 118/645

[58] Field of Search ..... 355/4, 32, 3 R, 3 DR, 355/14 R; 430/42, 43, 44; 118/645

[56] References Cited

U.S. PATENT DOCUMENTS 2,297,691 10/1942 Carlson ..... 430/31

FOREIGN PATENT DOCUMENTS 154467 9/1984 Japan ..... 355/4
115958 6/1985 Japan ..... 355/4

OTHER PUBLICATIONS

Eastman Kodak Research Disclosure, Apr. 1974, pp. 56, 57, 58.

*Focal Encyclopedia of Photography,* 1969, pp. 308–311, Ed. L. A. Mannheim et al., Lib. of Con #69-11420.

*Primary Examiner*—A. C. Prescott

*Attorney, Agent, or Firm*—Jordan B. Bierman

[57] ABSTRACT

An image forming apparatus wherein an image exposure device and a whole surface exposure device are arranged to face the photosensitive member having a surface insulating layer and a color separating function in its face, and one of the image exposure device and the whole surface exposure device is operative to expose the photosensitive member to light which does contain a visible light.

6 Claims, 8 Drawing Sheets

IMAGE FORMING APPARATUS

BACKGROUND OF THE INVENTION

1. Field of the Invention

The present invention relates to an image forming apparatus and, more particularly, to an image forming apparatus for forming a multicolor image by electrophotography.

2. Description of the Prior Art

A number of proposals have been made in the art as to the multicolor image forming apparatus using the electrophotography. The apparatus can be generally classified into the following broad categories. In a first category, electrostatic latent images having their colors separated are repeatedly formed and developed on a single photosensitive member so that the colors are superposed on the photosensitive member, or the toner images are transferred to a transfer material in each development so that the colors are superposed on the transfer material. In a second category, toner images in different colors are simultaneously formed on respective photosensitive members, the number of which corresponds to the number of colors, and are sequentially transferred to a transfer material to obtain a multicolor image. The latter apparatus is advantageous in its high speed because the formation of the toner images in respective colors is simultaneously conducted on the photosensitive members, respectively. Since it requires plural photosensitive members and exposing means, however, the apparatus is complicated and large-sized to raise its production cost so that its practicability is not good enough. Moreover, both of the above-specified multicolor image forming apparatus are seriously defective in that the registration is difficult in color superposition so that the color drift of the image cannot be completely prevented.

In order to drastically solve these problems, I have invented an apparatus for forming a multi-color image through a single image exposure on a photosensitive member. In this apparatus the multi-color image formation is conducted in the following manner by using a photosensitive member which is composed of an electroconductive member, a photoconductive layer and a plurality of different kinds of filters. By charging and image-exposing the surface of the above-specified photosensitive member, more specifically, an image of charge density is formed on the boundary surface between the insulating layer and the photoconductive layer. The boundary surface on which the image has been thus formed is wholly exposed to specified light to form a potential pattern in said filter portion of the aforementioned photosensitive member. This potential pattern is developed to form a monocolor toner image by a developing device which contains toner in a specified color. Then another whole surface exposure using light through a filter portion different from the preceding one and another development using a developing device containing toner in a color different from the preceding one are conducted to form a toner image in a second color on the photosensitive member. Subsequently, a desired number of whole surface exposures and developments are repeated. As a result, toners in the different colors stick to the respective filter portions of the photosensitive member of form a multicolor image (as should be referred to Japanese Patent Application Nos. 59-83096 and 59-187044). According to the multicolor image forming apparatus thus disclosed, there arises no fear of color drift because of the single image exposure.

My invention described above has succeeded in eliminating the aforementioned problems accompanying the multicolor image forming apparatus of the prior art. However, my further investigations have revealed that the following problems are still left unsolved.

The multicolor image forming apparatus described effects the color reproduction by the so-called "color adding method", in which the colors are not superposed in principle in the same position. For reproduction of black by toners of three colors of yellow, magenta and cyan, for example, these toners are so arranged on a recording member that they are not superposed on others, and the black is expressed as a composite of reflected light of the respective color components. However, this method has a tendency to make the monocolor image short of density. This is because the optical reflections of the respective toners on the recording member are of high intensity. For example, the black reproduced appears grey to the viewer even if the color balance is complete.

Moreover, it is difficult for the aforementioned filters to have ideal spectral characteristics, and most of them permit light other than visible light, especially infrared rays, to pass therethrough. On the other hand, many photosensitive members are sensitive not only to visible light but also to infrared rays or ultraviolet rays. Despite of these facts, the design of the spectral distribution of the filters and photosensitive members cannot be freely changed so that infrared rays or ultraviolet rays disturb the distribution of the sticking toners in color reproduction to fail in conducing the color reproduction in a high fidelity. Some reasons for this failure will be described in the following.

The filters each has a high transmissivity in the infrared range as shown in FIG. 21. On the other hand, a photosensitive member is required to have a panchromatic sensitivity over the visible range, 400 to 700 nm, in wavelength. Many photoconductive layers (which are made of Se (Te, Sb or As), $As_2Se_3$, Cu phthalocyan, a(amorphous)-Si or the like) for such a photosensitive member have a sensitivity not only in the infrared range (longer than 700 nm in wavelength) but also in the ultraviolet range (shorter than 400 nm). Such a combination of filters and photosensitive members is not special but rather general.

If such a photosensitive member undergoes an image exposure using light containing infrared and or ultraviolet rays, color information in the infrared and ultraviolet ranges is stored in the photosensitive member underlying the filters so that the color reproduction is not carried out in a high fidlity.

In the case of an image exposure containing infrared rays, for example, the blue (B), green (G) and red (R) filters are transparent to infrared rays so that an infrared image (in a color corresponding to infrared rays of 700 nm or more, especially 750 nm or more) transmits through all the filters to form a primary latent image in the photosensitive member. If this photosensitive member is subjected to a whole surface exposure to light in a specified color to form a secondary latent image and is then developed using yellow, magenta and cyan toners, the color reproduction is conducted not in a high fidelity such that the aforementioned infrared image portion is superposed on a visible image (within the wavelength range of 400 to 700 nm).

A similar problem arises, too, in the conventional multicolor image forming apparatus in which the image exposure, development and transfer are repeated for each color component, as described hereinbefore. In such a multicolor image forming apparatus of the prior art, however, the problem can be avoided by ignoring the resultant increase in the production cost by disposing a filter having excellent spectral characteristics such as an interference filter in the optical path. Despite of this possibility, however, it is impossible in the present technical state for the multicolor image forming apparatus, which has its photosensitive member formed of layers of several kinds of color separation filters, to be finely arranged with filters having as excellent spectral characteristics as an interference one.

SUMMARY OF THE INVENTION

The present invention has been conceived in view of the background thus far described and has an object to provide an image forming apparatus which can form a plurality of color-separated electrostatic latent images by a single image exposure so that it can eliminate any color drift and effect a color reproduction in a high fidelity.

The above-specified object of the present invention is achieved by an image forming apparatus comprising a photosensitive member having a surface insulating layer and a color separating function in its surface, wherein the improvement resides in that said photosensitive member has a photoconductive layer substantially spectrally insensitive to infrared rays and/or ultraviolet rays.

The above definition "substantially spectrally insensitive to infrared rays and/or ultraviolet rays" means that the spectral sensitivity in a wavelength range equal to or shorter than 400 nm and/or within a wavelength range equal to or longer than 750 nm is one third or less, preferably one fifth or less as high as the maximum spectral sensitivity.

The above-specified object of the present invention is also achieved by an image forming apparatus comprising: a photosensitive member having a surface insulating layer and a color separating function in its face; and image exposing means and whole surface exposure means arranged to face said photosensitive member, wherein the improvement resides in that at least one of said image exposing means and said whole surface exposing means is operative to expose said photosensitive member to light which does not substantially contain infrared rays and/or ultraviolet rays, or is a visible light.

The above definition "does not substantially contain infrared rays and/or ultraviolet rays" means that optical energy within a wavelength range of 400 to 750 nm is 80% or more, preferably 90% or more of the total optical energy. In other words, the light of wavelengths 400 nm or shorter and/or 750 nm or longer to irradiate the photosensitive member is 20% or less, preferably 10% or less of the total in irradiation energy.

BRIEF DESCRIPTION OF THE DRAWINGS

FIGS. 1, 2, 3, 4, 5, 6, 10, 11 and 14 are sections showing photosensitive members;

FIGS. 7, 8 and 9 are top plan views showing the photosensitive members;

FIGS. 12 and 13 are graphs illustrating the spectral sensitivities of photoconductive layers;

FIG. 15 a schematic section showing an image exposure apparatus;

FIG. 16 is a schematic front elevation showing the inside of an image forming apparatus;

FIGS. 17(*a*) to 17(*h*) are flow charts for explaining an image forming process;

FIG. 18 is a graph illustrating changes in the surface potential of the photosensitive member in the course of image formation;

FIG. 19 is a schematic front elevation showing the inside of another image forming apparatus; and FIG. 20 is a section showing a developing device.

DESCRIPTION OF THE PREFERRED EMBODIMENTS

Figure 1:
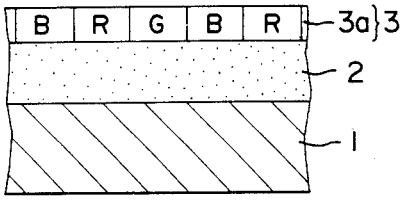
In FIGS. 1 to 20 showing embodiments of the present invention.
Figure 2:
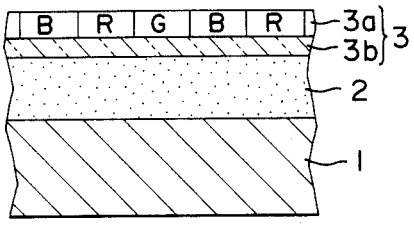
Figure 3:
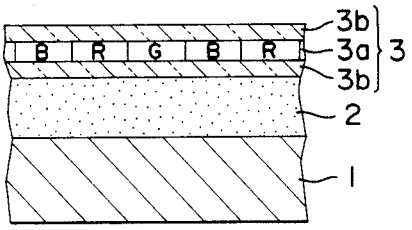
Figure 4:
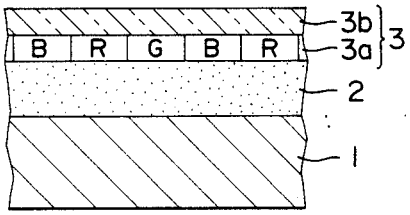

In FIGS. 1 to 6, reference numeral 1 designates an electroconductive substrate which is made of a metal such as aluminum, iron, nickel or copper or one of their alloys and which is formed into a suitable shape and structure, if necessary, such as a cylinder or endless belt. Reference numeral 2 designates either: a photoconductive layer, which is made of a photoconductive member made of sulfur, selenium, amorphous silicon, or an alloy containing such as sulfur, selenium, tellurium, arsenic or antimony, an inorganic photoconductive member made of an oxide, iodide, sulfide or selenide of a metal such as zinc, aluminum, antimony, bismuth, cadmium or molybdenum; or an organic photoconductive member prepared by dispersing an organic photoconductive substance such as vinylcarbazole, anthracenephthalocyanine, trinitrofluorenone, polyvinylcarbazole, polyvinylanthracene or polyvinylpyrene into an insulating binder resin such as polyethylene, polyester, polypropyrene, polystyrene, polyvinylchloride, polyvinylacetate, polycarbonate, acrylic resin, silicone resin, fluorine-contained resin or epoxy resin; or a function-separated type photoconductive layer which is composed of a charge generating layer and a charge transfer layer. Reference numeral 3 designates an insulating layer which includes a layer 3*a* composed of color separating filters made of a variety of polymers or resins and a coloring agent such as a dye and pigment for separating colors such as red (R), green (G) and blue (B). The insulating layer 3 of the photosensitive member of FIG. 1 is prepared by applying insulating substances such as resins, which are colored by adding coloring agents for forming the respective color separating filters, in a prescribed pattern to the photoconductive layer 2 by means of printing. The insulating layer 3 in the photosensitive member of FIG. 2 is prepared by forming the filter layer 3*a* in a prescribed pattern on the surface of a transparent insulating layer 3*b* which is formed by means known in the prior art. The insulating layer 3 in the photosensitive member of FIG. 3 is prepared by sandwiching the filter layer 3*a* between the transparent insulating layers 3*b*. The insulating layer 3 in the photosensitive member of FIG. 4 is prepared by forming the filter layer 3*a* on the photoconductive layer 2 and the transparent insulating layer 3*b* on the surface of the filter layer 3*a*. The filter layers 3*a* described above are prepared by means of printing, vacuum deposition or photoetching.

The insulating layers 3 may be prepared by forming an insulating film or sheet containing the filter layer 3*a* in advance and by applying or adhering the insulating film or sheet to the photoconductive layer 2 by suitable means.

Figure 5:
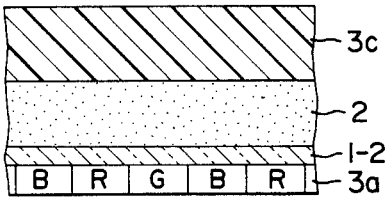

Moreover, the photosensitive member may be formed to have such a structure as has already been proposed by the present Applicant (in Japanese Patent Application No. 59-199547). For example, as shown in FIG. 5, the photoconductive layer 2 has its one side formed with an insulating layer 3*c* and its other side covered sequentially with a transparent electroconductive layer 1-2 and an insulating layer 3*a* composed of color separating filters to form a laminated structure. The transparent electroconductive layer 1-2 is formed by depositing a metal, for example. In the photosensitive member thus constructed, a later-described charging treatment is conducted from the side of the insulating layer 3*c*, and later-described image and whole surface exposures are conducted from the side of the insulating layer 3*a* composed of the color separating filters.

Figure 6:
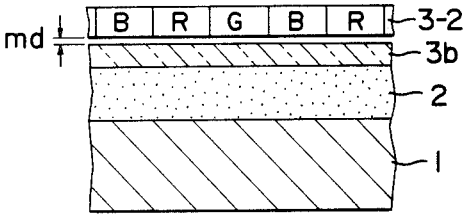

As shown in FIG. 6, still moreover, in a case of drum-shaped photosensitive member, it is also possible to form the transparent insulating layer 3*b* on the photoconductive layer 2 and a layer 3-2 composed of R, G and B filters (like the aforementioned layer 3*a*) coaxially on the layer 3*b* at a minute space md. More specifically, the cylindrical member 3-2 composed of the R, G and B filters is coaxially fitted at the minute space md around the drum-shaped photosensitive member having no filter, thus forming an integral structure. By adopting this structure, it is possible to select, interchange and use any arbitrary one of the filter layers having the constructions of FIGS. 7, 8 and 9 (as will be described hereinafter in detail). Incidentally, the space md should not be so enlarged that the images of filter cells may not be seriously blurred and projected on the insulating layer and the photoconductive layer. On the other hand, the transparent insulating layer 3*b* and the filter layer 3-2 are not completely spaced but may contact with each other.

Figure 7:
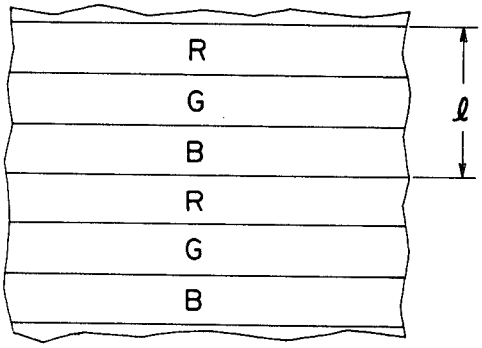
Figure 8:
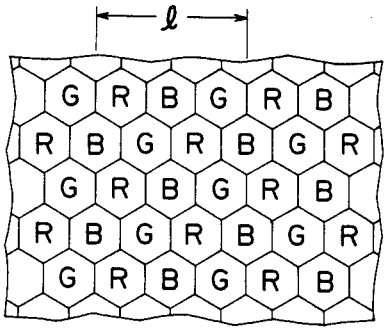
Figure 9:
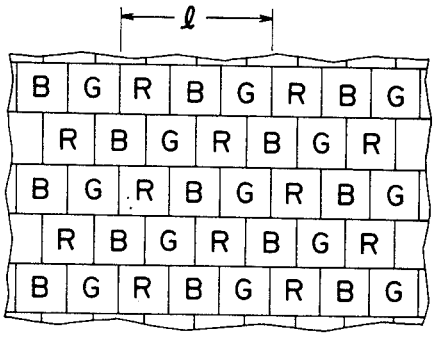

The filter layer 3*a*, which is formed by applying the coloring agents or the colored resins to the insulating layer 3, is not especially limited in the shapes and arrangement of the minute filters R, G and B. However, a stripe-shaped distribution as shown in FIG. 7 is preferable in view of simple pattern formation, or mosaic-shaped distributions as shown in FIGS. 8 and 9 are also preferable in view of reproduction of fine multicolored images. The array of the filters R, G and B in not only the mosaic-shaped distribution but also the stripe-shaped distribution may be oriented in any direction of extension of the photosensitive member. More specifically, in the case of the drum-shaped photosensitive member having a rotating photosensitive member, for example, the longitudinal direction of the stripes may be parallel, perpendicular or helical with respect to the axis of the photosensitive member. If the individual sizes of the filters R, G and B are excessively enlarged, the image has its resolution and color reproducibility dropped to have its quality degraded. If the filter sizes are excessively reduced to or smaller than the diameter of toner particles, on the contrary, the filters become liable to be influenced by adjoining other color portions and it becomes difficult to form their distribution patterns. It is therefore preferable that each individual filter portion has such a width or size as is indicated in the figures where l is 10 to 500 μm.

Incidentally, the individual filters are preferred to have high resistance values and are electrically insulated from one another. If they have low resistance values, they are electrically insulated by forming a gap space between them or sandwiching an insulating substance inbetween.

Figure 10:
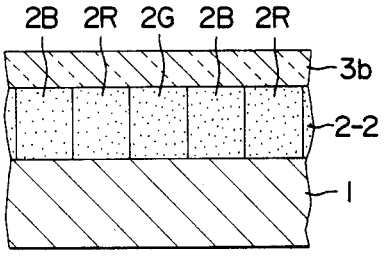
Figure 11:
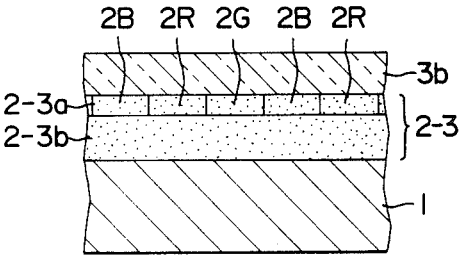

It is possible to use a photosensitive member which has its photoconductive layer given the color separating function without using the aforementioned layer 3*a* composed of color separating filters. FIGS. 10 and 11 show examples of the photosensitive member, which have already been proposed by the present Applicant (as is disclosed in Japanese Patent Application No. 59-201085). The photosensitive member of FIG. 10 is prepared: by forming on an electroconductive substrate 1 a photoconductive layer 2—2, which is composed of a number of photoconductive portions 2R, 2G and 2B having desired spectral sensitivity distributions, e.g., photoconductive portions sensitive to red (R), green (G) and blue (B); and by forming a transparent insulating layer 3*b* on the photoconductive layer 2—2. The photosensitive member of FIG. 11 is constructed: by forming a charge transfer layer 2-3*b* on an electroconductive substrate 1; by forming on the layer 2-3*b* a charge generating layer 2-3*a* which is composed of portions 2B, 2R and 2G having different spectral sensitivity distributions; and by forming a transparent insulating layer 3*b* on the layer 2-3*a*. In the photosensitive member of FIG. 11, the charge generating layer 2-3*a* and the charge transfer layer 2-3*b* construct together a photoconductive layer 2-3. The top plan structure of the photoconductive layer 2—2 of FIG. 10 and that of the charge generating layer 2-3*a* of FIG. 11 are similar to the ones shown in FIGS. 7, 8 and 9 like that of the aforementioned insulating layer composed of the color separating filters.

Next, the photoconductive layer suitable for the present invention will be described in the following.

From the aforementioned spectral characteristics of te color separating filters, the photoconductive layer is desired to be substantially spectrally insensitive to infrared rays and/or ultraviolet rays and is more desired to be substantially spectrally insensitive to infrared rays from the following reasons:

(i) Ultraviolet ray absorbing filters of high efficiencies are present and commercially available, but infrared ray absorbing filters are inferior in the absorbing characteristics to ultraviolet ones. In other words, an infrared ray absorbing filter considerably absorbs even the red component of visible light.

(ii) The spectral sensitivity of the photoconductive layer to ultraviolet rays is lower than the one to infrared rays.

(iii) A photoconductive layer having a sensitivity to infrared rays generally has a small ability of holding charges.

(iv) A lamp of high intensity such as a halogen lamp can be used as an exposure source. (The light of the halogen lamp has a large infrared component.)

Despite of these facts, however, the photoconductive layer is more desirably designed such that it has no spectral sensitivity in the shorter wavelength range of light which is allowed to pass through such color separating filters as blue and green ones.

Figure 12:
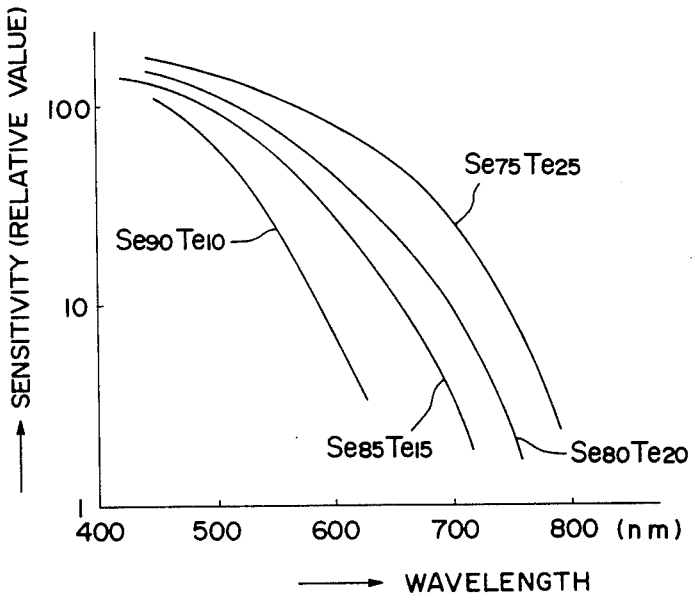

FIG. 12 shows the spectral sensitivity of a Se-Te photoconductive layer which has its wavelength range changing with the Te content. From FIG. 12, it is found desirable to use the Se-Te photoconductive layer containing about 20% of Te.

Figure 13:
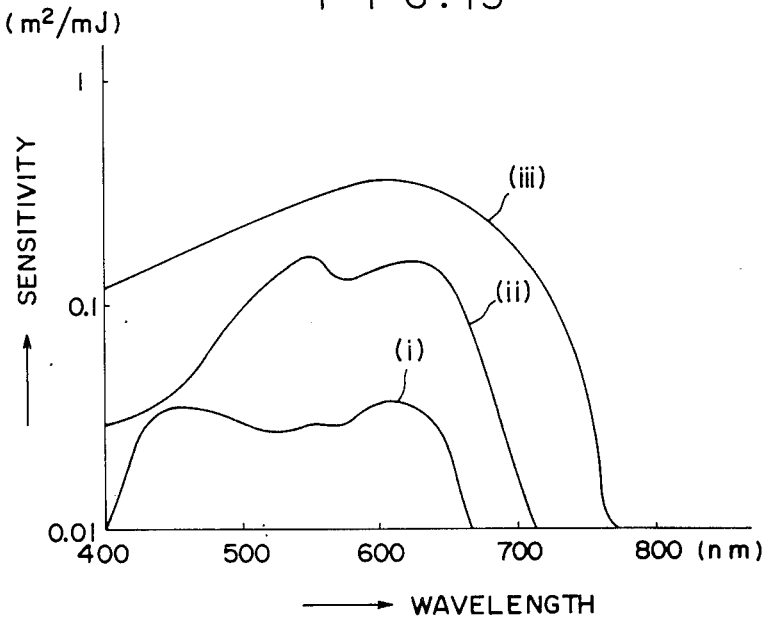
Figure 14:
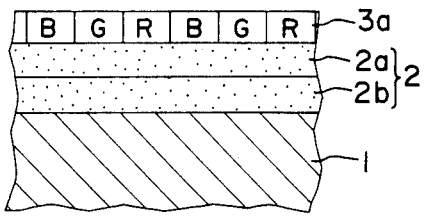

On the other hand, some organic photoconductive compounds (i.e., OPC) have no spectral sensitivity to infrared rays. The spectral sensitivity characteristics of the OPC are illustrated as an example in FIG. 13. A suitable photosensitive member having the photoconductive layer of the OPC has a two-layered structure which is composed of a charge generating layer (i.e., CGL) *2a* having a thickness of 0.1 to 5 μm and a charge transfer layer (i.e., CTL) *2b* having a thickness of 5 to 50 μm, as shown in FIG. 14. However, a photosensitive member having a single layer prepared by mixing the two layers *2a* and *2b* can also be used. A suitable photosensitive member of the two-layered structure may use a charge generating substance as the CGL and the CTL material as a binder. The substances constructing the photoconductive layer shown in FIG. 13 are enumerated in Table 1:

TABLE 1
| | CGL | CTL |
|---|---|---|
| (i) | 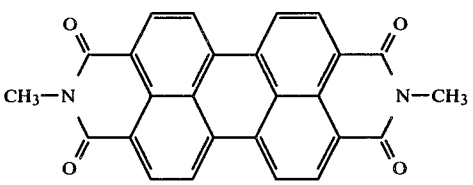 | 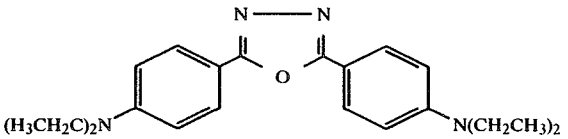 |
| (ii) | 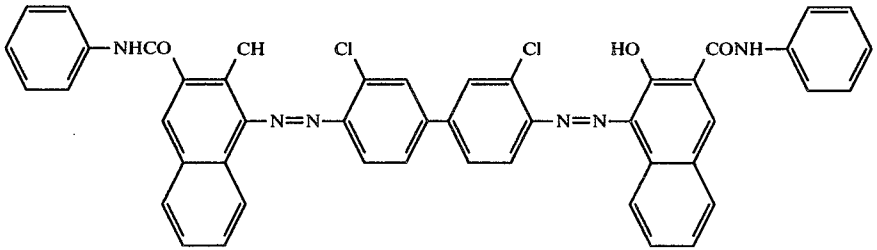 | 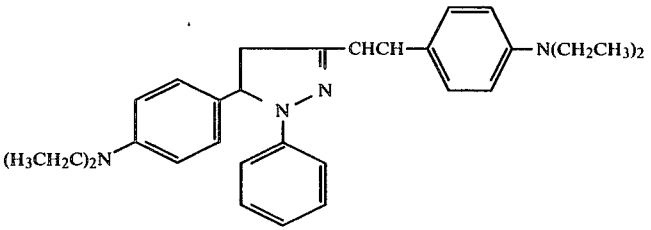 |
| (iii) | 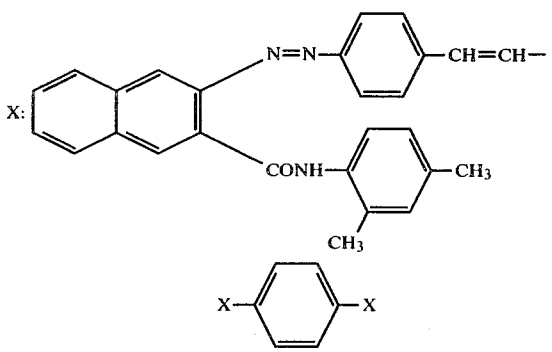 | 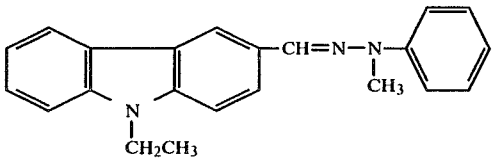 |

All the substances tabulated have almost no or very low spectral sensitivities to infrared rays. The combination (i) is hardly sensitive to ultraviolet rays, and no ultraviolet ray absorbing filter is requried for the combination.

If the above photoconductive layer substantially spectrally insensitive to infrared rays is used, any of the color separating filters B, G and R may have a spectral transmissivity in the range of 700 nm or longer, especially 750 nm or longer (i.e., in the infrared range).

Figure 15:
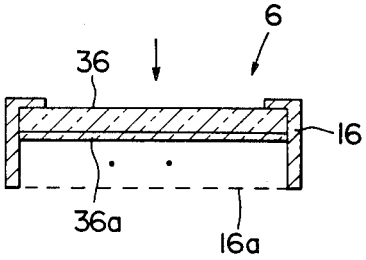

In the embodiment of the present invention, as shown in FIG. 15, the infrared component and/or ultraviolet component of the image exposing light are absorbed by disposing an infrared and/or ultraviolet absorbing filter 36 in the optical path of a charger 16 and by forming an electroconductive layer 36*a* of $InO_2$ as an electrode on the back of the filter 36 by deposition or sputtering. Reference numeral 16*a* appearing in FIG. 15 designates a grid. The filter may be disposed at the focusing portion of the lens. In this case, the aforementioned electroconductive layer can be dispensed with. The infrared ray absorbing filter can be exemplified by IRA-20 Produced by the Toshiba Electric Co., Ltd. This infrared ray absorbing filter considerably absorbs not only infrared rays but also a longer wavelength side of the visible range. However, the light source, a halogen lamp, has higher spectral energy on the longer wavelength side and is balanced through that filter so that the red color in the image obtained does not become thin. The ultraviolet ray absorbing filter can be exemplified by UV-37 produced by the Toshiba Electric Co., Ltd. In an alternative case, the aforementioned filters are not provided and a fluorescent lamp may be used as a light source not containing infrared rays or ultraviolet rays. Not to irradiate the photosensitive member with ultraviolet rays is effective for preventing the deterioration of the photoconductive layer by ultraviolet rays and the dissociation of pigments in the color separating filters.

Figure 17:
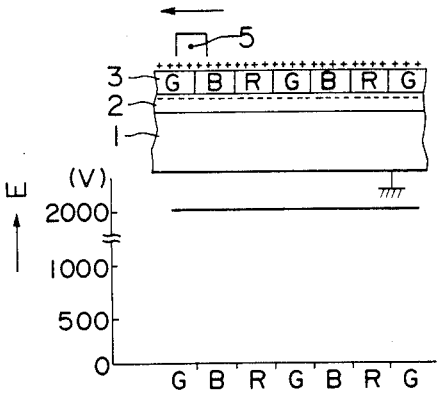
Figure 17:
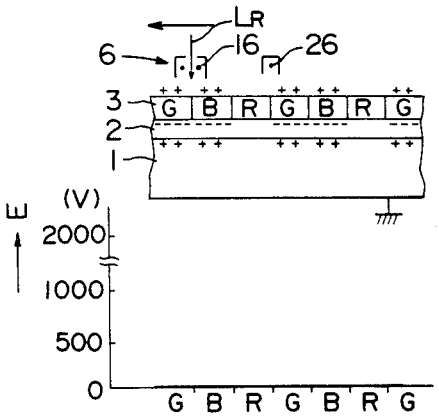
Figure 17:
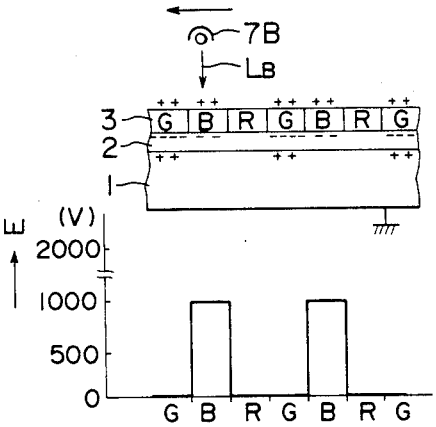
Figure 17:
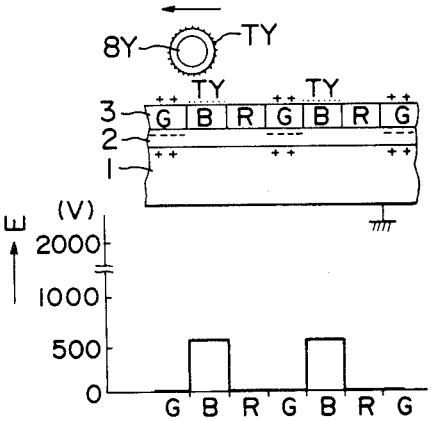
Figure 17:
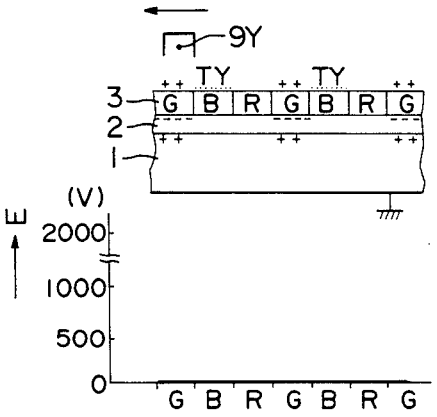
Figure 17:
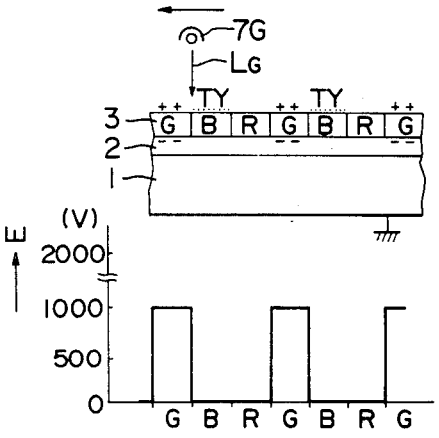
Figure 17:
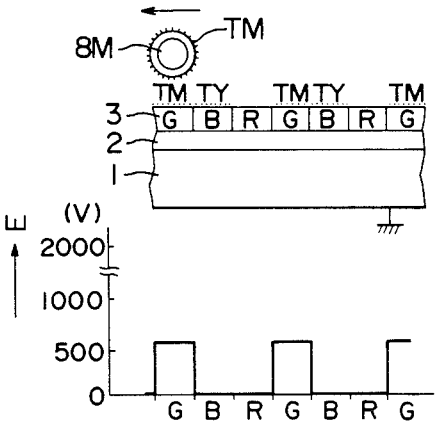
Figure 17:
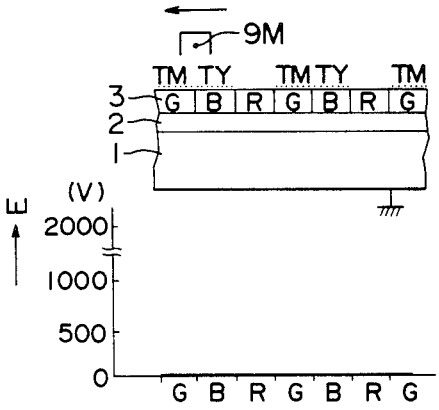

The principle of formation of a multicolor image on the photosensitive member thus constructed will be described in advance with reference to FIG. 17. Here, FIG. 17 shows an example in which a photoconductive member of an n-type semiconductor such as cadmium sulfide is used as a photoconductive layer 2 of a photosensitive member. Reference characters appearing in FIG. 17 designate members having the same functions as those of FIGS. 1 to 4.

FIG. 17(*a*) shows a state in which a photosensitive member is uniformly charged by the positive corona discharge of a charger 5. Positive charges are generated on the surface of an insulating layer 3, and negative charges are correspondingly induced in the boundary surface between the photoconductive layer 2 and the insulating layer 3 so that the surface potential of the photosensitive member is uniform, as illustrated in he graph of a potential E.

FIG. 17(*b*) shows a state, in which the aforementioned charged surface is subjected to an image exposure by means of an image exposure apparatus 6, and the changes in the charged face of the portion which has been irradiated with a red component $L_R$, for example. The red component $L_R$ passes through the R filter portion of the insulating layer 3 to make the underlying portion of the photoconductive layer 2 electroconductive. As a result, the charges on the surface of the insulating layer 3 and the negative charges on the boundary surface of the photoconductive layer 2 with the insulating layer 3 are caused to disappear from that particular portion by the charger 16. Moreover, the potential pattern is sufficiently smoothed by a charger 26. Since the G and B filter portions will not allow the red component $L_R$ to pass therethrough, on the contrary, the negative charges in the photoconductive layer 2 remain left at that portion. Similar phenomena occur for other color components of the image exposure. Thus, on the boundary surface between the insulating layer 3 and the photoconductive layer 2 is formed a latent image of a charge density corresponding to each color component of the respective filters. By the actions of the chargers 16 and 26 of the image exposure apparatus 6, however, the surface potential of the photosensitive member becomes constant, as illustrated in the graph of the potential E, irrespective of whether the amount of charges on the boundary surface between the insulating layer 3 and the photoconductive layer 2 are more or less, i.e., whether the image exposing light has been radiated or not. The green and blue components of the image exposing light give similar results, and their accumulated state is a resultant state of image exposure conducted by the image exposure apparatus 6 so that it does not function as it is as an electrostatic image.

FIG. 17 (*c*)shows a state in which the aforementioned image-exposed surface is uniformly exposed to blue light $L_B$ obtained from a lamp 7B. The blue light $L_B$ does not pass through the R and G filter portions to cause no change in these portions, but passes through the B filter portion to make the underlying photoconductive layer 2 electroconductive. As a result, the charges on the upper and lower boundary surfaces of the photoconductive layer 2 corresponding to the B filter portion are neutralized so that a potential pattern of the preceding image exposing light for forming an image in the color complementary to the blue color appears on the surface of the insulating layer 3 at the B filter portion, as illustrated in the graph.

FIG. 17(*d*) shows a state in which the potential pattern formed by the whole surface exposure to the blue light $L_B$ is developed by a developing device 8Y containing yellow toner TY charged negatively. The yellow toner TY sticks exclusively to the B filter portion having potential changed by the whole surface exposing step but not the R and G filter portions having no potential change. As a result, the yellow toner image of one separated color is formed on the surface of the photosensitive member The potential of the B filter portion, to which the yellow toner has adhered, is dropped more or less by the development, but the surface potential does not become uniform, as illustrated in the graph.

FIG. 17(*e*) shows a state in which the surface of the photosensitive member that has the yellow toner image formed is subjected to a corona discharge by a charger 9Y. The discharge by this charger 9Y drops the potential of the B filter portion having the yellow toner TY sticking thereto and makes the surface potential uniform. This surface potential of the photosensitive member is illustrated in the graph.

Subsequently, the surface of the photosensitive member of FIG. 17(*e*) that has the yellow toner image formed has its whole surface exposed to green light obtained from a lamp. As a result, a potential pattern then appears in the G filter portion, as has been described with reference to FIG. 17(*c*). If this potential pattern is developed by a developing device containing the magenta toner, this toner sticks exclusively to the G filter portion to form a magenta toner image similarly to FIG. 17(*d*). As a result, the two-color toner images are formed on the photosensitive member. Moreover, this image-formed surface is subjected to a corona discharge by a charger similarly to FIG. 17(*e*) to make the surface potential uniform. These processes are shown in FIGS. 17(*f*), 17(*g*)and 17(*h*)

If the surface of the photosensitive member that has the two-color toner images formed subsequently has its whole area subjected to red light obtained from a lamp, a potential pattern then appears in the R filter portion, as has been described with reference to FIG. 17(*c*) A cyan toner image is formed by developing that potential pattern by a developing device containing the cyan toner. In this case, no potential pattern is formed because of the red image so that no cyan toner sticks. Thus, the red image is reproduced from the yellow toner and the magenta toner.

After completion of the steps described above, a clear three-color image having neither color drift nor vagueness is formed on the photosensitive member The reproduction of an original image using yellow, magenta and cyan toners by the three-color separating method described above is enumerated in Table 2. In Table 2: a symbol of broken circle " ◌ " indicates that an image pattern of charge density is formed on the boundary surface between the insulating layer 3 and the photoconductive layer 2 of the photosensitive member; a symbol of circle " ○ " indicates that an image-shaped potential pattern appears on the surface of the photosensitive member; a symbol of solid circle " ◍ " indicates that a toner image, is formed; a symbol of downward arrow " ↓ " indicates that a state of upper column is held as it is; and a blank indicates a state in which no image is present. A symbol of minus sign "—" indicates that no toner sticks, and letters Y, M and C respectively indicates that the yellow, magenta and cyan toners stick.

that all the plus and minus symbols of the charges are reversed. In case it is difficult to inject the charges when the photosensitive member is to be charged, a uniform irradiation using light may be used together.

The multicolor image forming apparatus of FIG. 16 performs the image formation on the basis of the principle so far described and forms a multicolor image in the following manner while the drum-shaped photosensitive member 4 makes one turn in the direction of the arrow. More specifically, the surface of the photosensitive member 4 is uniformly charged by the charger 5. This charged surface is subjected to an image exposure conducted by an image exposure apparatus 6 through an infrared and ultraviolet cutting filter attached to the charger 5 using reflected light coming from an original irradiated with white light from a halogen light source, so that the surface potential of the photosensitive member 4 is made generally uniform by the charger 16, which effects either an a.c. discharge or a d.c. corona discharge of a polarity opposite to that of the charger 5. Subsequently, the surface potential of the photosensitive member 4 is made completely flat by a charger 26 similar to the charger 16. Incidentally, the charger 26 may be disposed adjacent to and downstream of the charger 16 of the image exposure apparatus 6 so that they may be integrated.

Next, the surface subjected to the image exposure is uniformly irradiated with the blue light $L_B$ obtained from a lamp 7B so that a potential pattern for giving an image in a color complementary to the blue appears on the surface subjected to the image exposure. This potential pattern is developed by the developing device 8Y containing the yellow toner. Subsequently, the surface potential of the photosensitive member 4 is made uniform by the action of the charger 9Y for effecting corona discharge similar to that of the charger 16. This

TABLE 2

| Originals | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Insulating Layer Filter | R | G | B | R | G | B | R | G | B | R | G | B | R | G | B | R | G | B | R | G | B | R | G | B |
| Image Exposure | | | | | ◌ | ◌ | ◌ | | ◌ | ◌ | ◌ | | | | ◌ | | ◌ | | ◌ | | | ◌ | ◌ | ◌ |
| Blue Whole Surface Exposure | | | | | ↓ | ◌ | ↓ | | ◌ | ↓ | ↓ | | | | ◌ | | ↓ | | ↓ | | | ↓ | ↓ | ◌ |
| Yellow Development | | | | | | ◍ | ↓ | | ◍ | ↓ | ↓ | | | | ◌ | | ↓ | | ↓ | | | ↓ | ↓ | ◌ |
| Blue Whole Surface Exposure | | | | | ◌ | | ↓ | | | ↓ | ◌ | | | | | | ◌ | | ↓ | | | ↓ | ◌ | |
| Magenta Development | | | | | ◌ | | ↓ | | | ↓ | ◍ | | | | | | ◍ | | ↓ | | | ↓ | ◌ | |
| Red Whole Surface Exposure | | | | | | | ◌ | | | ◌ | | | | | | | | | ◌ | | | ◌ | | |
| Cyan Development | | | | | | | ◌ | | | ◍ | | | | | | | | | ◍ | | | ◍ | | |
| Toner Having Sticked | — | — | — | — | M | Y | C | — | Y | C | M | — | — | — | Y | — | M | — | C | — | — | C | M | Y |
| Reproduction | White | | | Red | | | Green | | | Blue | | | Yellow | | | Magenta | | | Cyan | | | Black | | |

Figure 18:
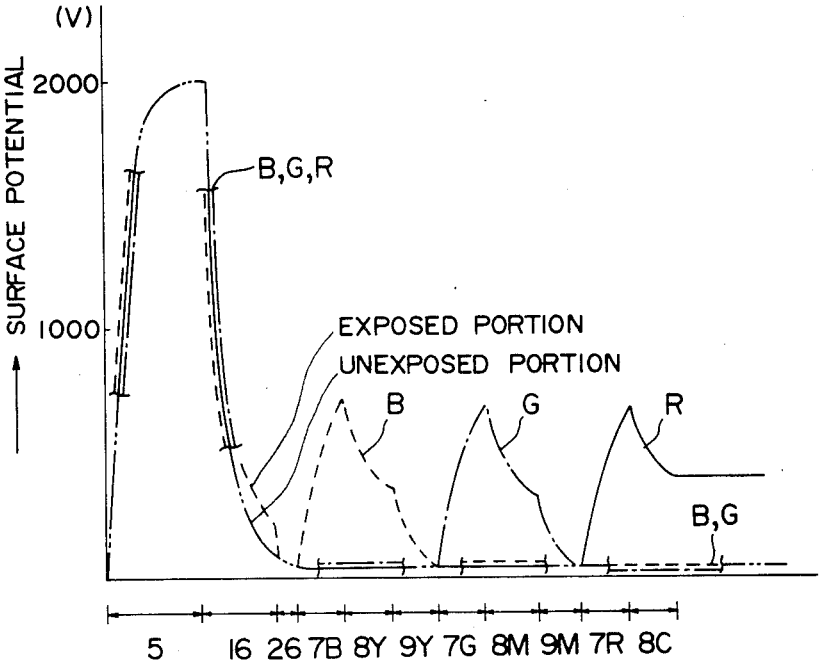
Figure 21:
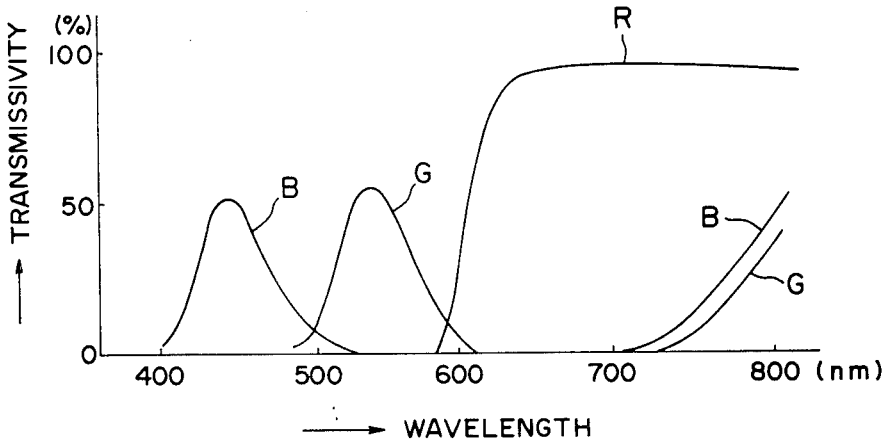
FIG. 21 is a graph illustrating the spectral characteristics of color separating filters.

Moreover, FIG. 18 shows status in which the surface potentials of the respective filter portions B, G and R of the photosensitive member change in accordance with the image forming processes thus far described. In FIG. 18, reference characters 5, 16, 26, 7B, 8Y, 9Y, 7G, 8M, 9M, 7R and 8C designate the respective steps at which the members bearing the same reference characters in FIG. 16 or 17 act upon the photosensitive member, and letters B, G and R designate the maximum or minimum potentials of the respective filter portions. (Intervals between the aforementioned processes, e.g., the interval between the primary and secondary charging treatments or the inverval between the whole surface exposure and the development are omitted.)

Incidentally, FIG. 17 shows an example in which the photoconductive layer 2 of the photosensitive member is made of an n-type optical semiconductor, but the fundamental image forming processes with respect to the photoconductive layer 2 made of a p-type optical semiconductor such as selenium are unchanged except surface is then uniformly irradiated with green light $L_G$ obtained from the lamp 7G to form a potential pattern for giving an image in a color complementary to the green. This potential pattern is developed by the developing device 8M containing the magenta toner to form a two-color toner image on the surface of the photosensitive member 4. Likewise, the discharge of the charger 9M like the charger 9Y, the uniform irradiation of red light $L_R$ obtained from a lamp 7R, and the development by the developing device 8C containing the cyan toner are subsequently conducted.

By the steps described above, a superposed image of three color toner images of yellow, magenta and cyan is formed on the photosensitive member 4. In case it is desired to obtain an image in better reproduced black, the multicolor toner image thus formed is irradiated, after the recharging treatment, with infrared rays of a lamp to form potential patterns through the respective toners and filters. These potential patterns are caused to pass, without any developing treatment, through a developing device 8K containing black toner held in its inoperative state. Then, the potential patterns are charged by a pretransfer charger 14 so that they may become liable to be transferred. The patterns thus charged are then transferred to the recording paper P, which is being fed from a not-shown paper feeder, by a transfer device 10. The recording paper P bearing the multicolor toner image transferred thereto is separated from the photosensitive member 4 by a separating device 11 and is conveyed by not-shown conveyor means to a fixing device, in which the multicolor image is fixed, until the recording paper P bearing the multicolor image thus fixed is discharged out of the apparatus. The charges are eliminated from the surface of the photosensitive member 4 bearing the multicolor toner image transferred thereto by the action of a charge eliminating device 12 that effects the exposing and discharging treatments. The photosensitive member 4 is cleared of the residual toner by the action of a cleaning device 13 to restore its state in which a next image formation is prepared again.

In this multicolor image forming apparatus of FIG. 16, a monocolor image is formed in the following manner. More specifically, the chargers 9Y, 9M and 9C are brought into their inoperative states, and the charge, discharge and image exposure are conducted respectively by the charger 5 and the chargers 16 and 26 in the same manner as in the case of multicolor image formation. And, three lamps are prepared as the lamp 7B and are simultaneously turned on to effect the whole surface exposures to blue, green and red light. As a result, potential patterns appear on the whole surface of the photosensitive member 4. These patterns are developed using one or more of developing devices 8Y to 8K to form a monocolor toner image. Like the case of the multicolor image formation, the monocolor toner image is subsequently transferred and fixed to the recording paper P, and the surface of the photosensitive member 4 bearing the monocolor toner image transferred thereto is then cleaned.

In the multicolor image forming process described above, the respective whole surface exposing light should not be necessarily limited to the light of B, G and R. As the filter portions of the photosensitive member, through which the whole surface exposure light has already passed, have already lost the charges on the boundary surface between the insulating layer and the photoconductive layer, more specifically, the surface potential will not change even if the light passes again. As a result, a multicolor image having succeeded in excellently reproducing the colors of the original can be obtained even if the whole surface exposures are conducted in the order of red, yellow and white light, for example, and if the developments are accordingly conducted in the order of the cyan, magenta and yellow toners. Naturally, the lights should not be limited to the above-specified ones, but tee whole surface exposures may be conducted using light of other spectral distributions. Incidentally, if the whole surface exposing lights pass twice or more through the partial filters on the photosensitive member, as mentioned above, light may desirably be irradiated after the development so as to completely eliminate the charges on the boundary surface between the insulating layer and the photoconductive layer. Thus, the whole surface exposure light forms the potential patterns exclusively on the filters of the special kinds respectively corresponding thereto.

According to the multicolor image forming apparatus disclosed by the present invention, as has been described hereinbefore, it is possible not only to form a multicolor image without any color drift but also to form a monocolor image having an excellent image density and resolution.

Moreover, preclusion of the infrared rays from the image exposing light results in an effect to prevent changes in the electric characteristics (e.g., received potential, dark decay, optical sensitivity or repeating characteristics) due to the heating treatment of the photoconductive layer. On the other hand, preclusion of ultraviolet rays from the image exposing light results in an effect to prevent the degradation of the photoconductive layer and the pigment dissociation in the filter layers.

Figure 16:
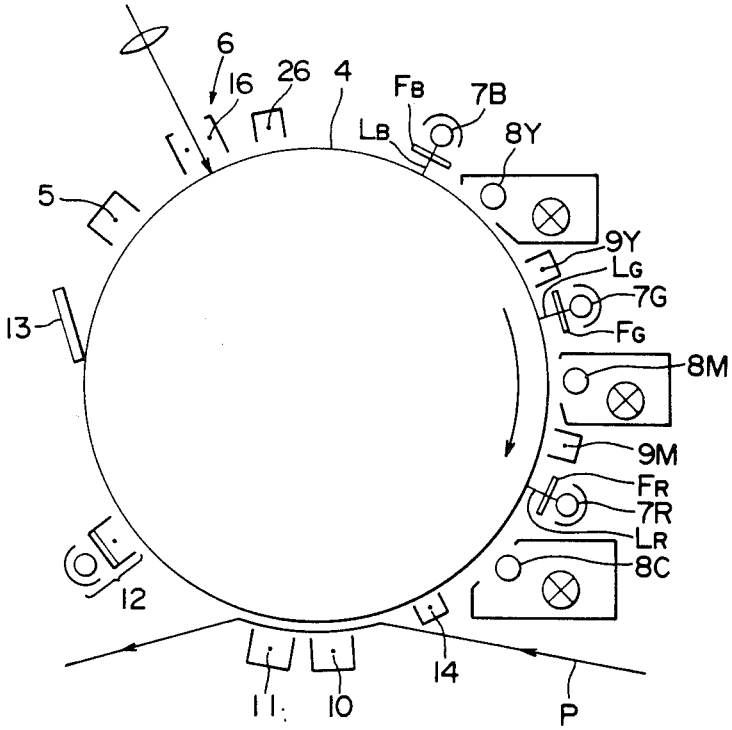
Figure 19:
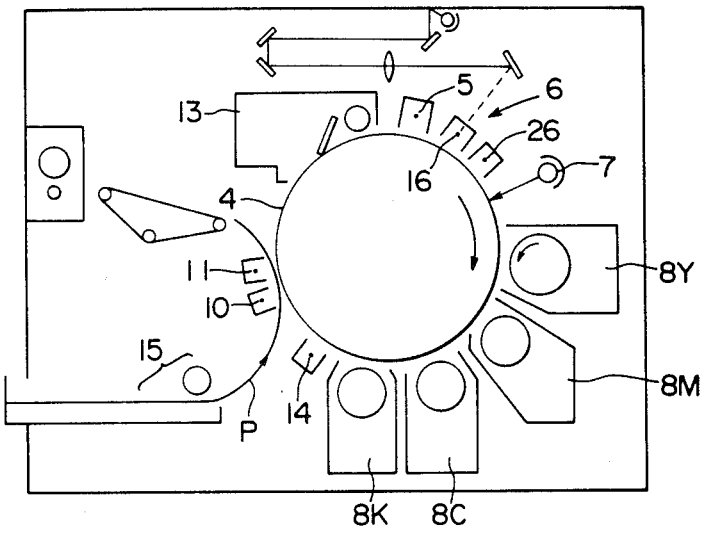

A multicolor image forming apparatus shown in FIG. 19 is different from that of FIG. 16 in that a toner image in one color is formed by one rotation of the photosensitive member 4, in that the whole surface exposure are conducted by lamps 7 for blue, green, red and infrared light, which are switched or used altogether, and in that the surface potential of the photosensitive member 4 having been developed is made uniform by making use of the charger 16 of the image exposure apparatus 6.

In this image forming apparatus, too, the same image forming operation as the one described with reference to FIG. 17 can be conducted, as in the multicolor image forming apparatus of FIG. 16, to form a multicolor image without any color drift and a monocolor image having an excellent image density and resolution. In case a three-color image, for example, is to be formed, more specifically, the photosensitive member 4 is charged by the charger 5 and is subjected to an image exposure by the charger 16. After the surface potential has been made uniform, the surface of the photosensitive member 4 is wholly exposed to blue light of the lamp 7, and the resultant potential pattern is developed by the developing device 8Y to form an yellow toner image. This toner image is allowed to pass without being affected by the developing devices 8M, 8C and 8K, the pretransfer charger 14, the transfer device 10, the separating device 11, the cleaning device 13 and the charger 5. The photosensitive member 4 with the toner image thus formed is subjected to a corona discharge, when it reaches the positions of the chargers 16 and 26, to make its surface potential uniform and then has its surface wholly exposed to green light obtained from the lamp 7G, thus forming a potential pattern. This potential pattern is then developed by the developing device 8M to form a magenta toner image. Likewise, the formation of the a potential pattern by red light and the development by the developing device 8C are conducted. In case an image having better reproduced black is to be formed, infrared rays are then radiated by the lamp 7 to form a potential pattern. This potential pattern is developed by the developing device 8K to have a black toner sticking thereto to form a color image.

It is advantageous that the infrared rays do not obstruct the formation of the potential pattern because they pass through the toner having already sticked.

In case a monocolor image is to be formed, the photosensitive member 4 having been charged and subjected to the image exposure has its whole surface exposed to the blue, green, red or their combined light of the lamps 7 to form a potential pattern on the surface thereof. This potential pattern can be developed by one or a combination (i.e., superposition of the toners on a common latent image) of the developing devices 8Y to 8K to form a monocolor image having a sufficient image density and resolution. This multicolor image forming apparatus has such a simple construction as is hardly different from a monocolor copying machine except that the number of the developing devices is increased, and is advantageous in that its size and production cost can be reduced. The same reference characters in FIG. 15 as those in FIG .12 designate the members having the same functions.

Figure 20:
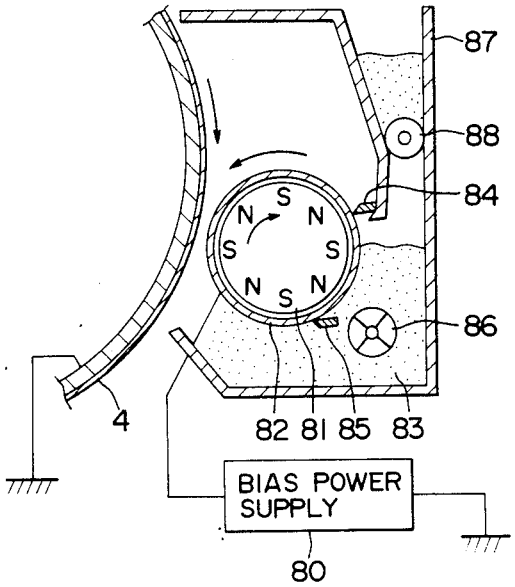

For the developing devices 8Y to 8K of the multicolor image forming apparatus of FIGS. 16 and 19, there may preferably be used such a magnetic brush developing device as is shown in FIG. 20.

In the developing device of FIG. 20, at least either of a developing sleeve 81 and a magnet 82, which has N and S magnetic poles on the inner circumference of the developing sleeve 81, is rotated to convey the developer, which has been attracted onto the surface of the developing sleeve 81 from a developer reservoir 83 by the magnetic force of the magnet 82, in the direction of the arrow. In the course of conveyance of the developer, moreover, the quantity of the developer being conveyed is regulated according to a thickness regulating blade 84 to form a developer layer. This developer layer develops the photosensitive member 4 in a developing region facing the developing sleeve 81 in accordance with the potential pattern of the photosensitive member 4. Upon this development, a developing bias voltage is applied by a bias power supply 80 to the developing sleeve 81. If necessary, moreover, a bias voltage may be applied to the developing sleeve 81, even in case no development is conducted, so as to prevent the toners from moving from the developing sleeve 81 to the photosensitive member or vice versa. Incidentally, when the development is off: the a.c. bias component on the development (when on) is cut to leave the d.c. bias component only; the bias voltage is brought into its floating state or grounded; a d.c. bias in the same polarity as that of the toners is applied; or the developing device is brought apart from the image forming member. Alternatively, these treatments can be conducted together. Reference numeral 85 designates a cleaning blade for removing the developer layer having passed from the developing region from the developing sleeve 81 to return it to the developer reservoir 83. Numeral 86 designates stirring means for stirring and uniforming the developer in the developer reservoir 83 and for frictionally charging the toners. Numeral 88 designates a toner supply roller for supplying the toners from a toner hopper 87 to the developer reservoir 83.

The developer to be used in such a developing device may be either the so-called "one-component developer" composed exclusively of a toner or the so-called "two-component developer" composed of a toner and a magnetic carrier. For development, there may be used a method of directly rubbing the surface of the photosensitive member with the developer layer, i.e., the magnetic brush. Especially in order to avoid any damage of the toner image formed on and after the second development, it is preferable to use a developing method in which the developer layer does not contact with the surface of the photosensitive member, as is disclosed in U.S. Pat. No. 3,893,418 or Japanese Patent Laid-Open No. 55-18656, especially in Japanese Patent Applications Nos. 58-57446, 58-238295 and 58-238296. In these methods, a one- or two-component developer containing a nonmagnetic toner capable of freely selecting its coloration is used to form an alternating electric field in the developing region so that the development may be effected without any contact between the electrostatic image bearer and the developer layer. This non-contact development is set to make the gap between the developing sleeve and the surface of the photosensitive member larger than the thickness of the developer layer lying on the developing sleeve (wherein there is no potential difference inbetween) so that the development may be conducted with the above-specified gap and thickness under the aforementioned various conditions.

The color toner to be used for the development can be exemplified by the toner for electrostatic development, which is composed by the prior art of a known binding resin usually used in the toner, a variety of chromatic or achromatic coloring agents such as organic or inorganic pigments or dyes, and a variety of magnetic additives. The carrier can be exemplified by a variety of known carriers or magnetic carriers used commonly for an electrostatic image, such as iron powder, ferrite powder, iron or ferrite powder coated with resin, or dispersed agents containing magnetic material dispersed in resin.

On the other hand, the developing method disclosed in Japanese Patent Applications Nos. 58-249669 and -240066 having been previously filed by the present Applicant may be used.

Specific embodiments of the present invention will be described in the following.

The photosensitive member 4 of the multicolor image forming apparatus of FIG. 16 had an external diameter of 180 mm and was rotatable at a surface velocity of 200 mm/sec, comprising a photoconductive layer of Se-Te (in which Te is 20%) having a thickness of 40 μm formed on a conductive layer and, on this photoconductive layer, an insulating layer having a thickness of 20 μm and composed of a mosaic-shaped array of R, G and B filter portions each having a thickness l of 100 μm. A halogen lamp was used as the image exposing light source. A developing device having the construction shown in FIG. 20 was used as the developing devices 8Y, 8M, 8C and 8K. A developing sleeve 81 was made of non-magnetic stainless steel to have an external diameter of 30 mm and rotatable for the development at a surface velocity of 140 mm/sec in the direction of the arrow. The magnet 82 had eight N and S magnetic poles to give magnetic flux of a maximum density of 800 G to the surface of the developing sleeve 81 and was rotatable at 600 r.p.m. in the direction of the arrow for the development. The surface interval between the photosensitive member 4 and the developing sleeve 81 was equally set at 0.75 mm in the developing devices 8Y, 8M, 8C and 8K (8K being not shown in the drawing) respectively to form a developer layer having a thickness of 0.5 mm on the developing sleeve 81 The developer was prepared by mixing at a weight ratio of 1:9 a toner having an average particle diameter of 10 μm for frictional charging of 10 to 20 μc/g and a carrier made of a resin containing a dispersed magnetic material and having an average particle diameter of 25 μm and a resistivity of $10^{13}$ Ωcm or more. It is quite natural that the colors of the toners were different, being yellow, magenta, cyan and black according to the developing devices 8Y, 8M, 8C and 8K, respectively. The charger 5 was xemplified by the corotron discharger, and all the charger 16 (which should be referred to FIG. 15) having an ultraviolet cut filter 36 at its back and the chargers 26, 9Y and 9M were exemplified by the scorotro chargers. And, a discharge voltage for setting the surface potential of the photosensitive member 4 at −15 kV was applied to the charger and a discharge voltage for setting the surface potential at 0V was applied to the charger 16 and the chargers 26, 9Y and 9M. The potential contrast obtained was 200 to 400V for each latent image. Moreover, in the developments conducted by the developing devices 8Y, 8M and 8C, respectively, blue, green and red light was used for the whole surface exposures, and a developing bias voltage having superposed therein a d.c. voltage of −50V and an a.c. voltage of an effective value of 1.5 kV and a frequency of 2 kHz was applied to the developing sleeve 81. In case the development was conducted by the developing device 8K (not shown in the drawing), on the other hand, white light was used for a further whole surface exposure after the recharge, and a developing bias voltage having superposed therein a d.c. voltage of −100V and an a.c. voltage of an effective value of 2.5 kV and a frequency of 2 kHz were applied to the developing sleeve 81.

Incidentally, in case the development was conducted by the developing device 8K, the black color to be reproduced by the Y, M and C toners did not have a sufficient density. In order to supplement this density, the black toner was caused to stick to the Y, M and C toners. In order to ensure the sticking of a quantity of the toner necessary for it and to minimize the toner sticking to the toner for reproducing other chromatic colors, the black toner was caused to stick to the toner having a certain density or more. In portions where the toners in sufficient densities have already sticked, the potential contrast is low enough to reduce the quantity of the toner having sticked. However, in order that the black toner may be reluctant to stick to a lower potential portion and liable to stick to a higher potential portion so as to set the quantity of the black toner to stick at a desired value, as has been described above, it is more preferable to increase the d.c. component of the developing bias and to highly control the a.c. component.

The color images were formed with or without the black toner added under the above-specified conditions, as has been described with reference to FIG. 17. The color images obtained had no color drift, excellent color reproducibility, high image density and contrast, and excellent resolution.

For comparison, on the other hand, the image was formed by making the filter at the back of the charger 16 transparent to leave the infrared component uncut but under other similar conditions. The quantity of the cyan toner having sticked to the R filter portions on the photosensitive member was reduced together with the quantities of the yellow toner at the B filter portions and the magenta toner at the G filter portions so that the color balance was lost. However, the color reproduction in a high fidelity could not be obtained even if the developing conditions (such as the d.c. bias voltage, a.c. bias voltage or frequency) were changed to increase the image density so as to correct the color balance.

The embodiments thus far described are directed to examples in which the image exposure was conducted with light which did not contain infrared rays and/or ultraviolet rays. The fidelity of color reproduction can also be enhanced if infrared rays and/or ultraviolet rays are precluded from the whole surface exposing light in a specified color. Moreover, the fidelity of the color reproduction can be better enhanced if a light containing either or neither of infrared rays and ultraviolet rays is used as the image exposure light and whole surface exposure light.

On the other hand, the examples described above are directed to the normal image forming. Despite this fact, however, the present invention can naturally be applied similarly to both the photosensitive member having the color separating function and the reversal image forming method, as have been disclosed in Japanese patent Applications Nos. 59-199547, 59-201084, 59-201085 and 59-187045.

As has been described hereinbefore, the image forming apparatus based on the present invention is constructed to include a photosensitive member having a surface insulating layer and a color separating function and to have a predetermined exposure light substantially spectrally insensitive to infrared rays and/or ultraviolet rays. This makes it possible to form a latent image having a plurality of color components by a single image exposure, and the image formation is not adversely affected by infrared rays and/or ultraviolet rays. As a result, the image obtained is freed from any color drift and any breakage of color balance with a high fidelity of image reproduction.

What is claimed is:

1. An image forming apparatus comprising: a photosensitive member having a surface insulating layer and a color separating function on a surface thereof and an image exposure means and a whole surface exposure means arranged to face said photosensitive member, wherein at least one of said image exposure means and said whole surface exposure means is operative to expose said photosensitive member to light which does substantially contain a visible light.

2. The image forming apparatus according to claim 1, wherein said light from the exposure means does not contain infrared rays.

3. The image forming apparatus according to claim 1, wherein said light from the exposure means does not contain ultraviolet rays.

4. The image forming apparatus according to claim 1, wherein said photosensitive member has a photoconductive layer substantially spectrally sensitive to a visible light.

5. The image forming apparatus according to claim 1, wherein said photosensitive member is substantially spectrally insensitive to infrared rays.

6. The image forming apparatus according to claim 1, wherein said photosensitive member is substantially spectrally insensitive to ultraviolet rays.

* * * * *